US008497780B2

(12) United States Patent
Uhm

(10) Patent No.: US 8,497,780 B2
(45) Date of Patent: Jul. 30, 2013

(54) PROXIMATE LOCATION DETECTION SYSTEM

(75) Inventor: Hyun Duk Uhm, Seoul (KR)

(73) Assignee: ID. Fone Co., Ltd., Seoul (KR)

( * ) Notice: Subject to any disclaimer, the term of this patent is extended or adjusted under 35 U.S.C. 154(b) by 519 days.

(21) Appl. No.: 12/823,115

(22) Filed: Jun. 24, 2010

(65) Prior Publication Data

US 2011/0181434 A1 Jul. 28, 2011

(30) Foreign Application Priority Data

Jan. 27, 2010 (KR) ..... 10-2010-0007285

(51) Int. Cl.
*G08B 21/00* (2006.01)

(52) U.S. Cl.
USPC ..... 340/686.6; 340/539.1; 340/539.13; 340/539.23; 340/573.1; 340/825.49; 362/105; 362/106

(58) Field of Classification Search
USPC ..... 340/686.6, 686.1, 539.1, 539.13, 340/539.23, 825.49, 573.1, 573.4; 362/105, 362/106
See application file for complete search history.

(56) References Cited

U.S. PATENT DOCUMENTS

| | | | | |
|---|---|---|---|---|
| 5,329,637 | A * | 7/1994 | Walker | 2/5 |
| 5,408,393 | A * | 4/1995 | Becker | 362/105 |
| 6,157,298 | A * | 12/2000 | Garfinkel et al. | 340/479 |
| 6,545,606 | B2 * | 4/2003 | Piri et al. | 340/573.1 |
| 7,843,326 | B2 * | 11/2010 | Weber et al. | 340/531 |
| 8,025,432 | B2 * | 9/2011 | Wainright | 362/394 |
| 8,083,365 | B2 * | 12/2011 | Cohen et al. | 362/106 |
| 2003/0112144 | A1 * | 6/2003 | Campman | 340/573.1 |
| 2008/0272919 | A1 * | 11/2008 | Newman et al. | 340/573.1 |
| 2009/0195434 | A1 * | 8/2009 | Chen et al. | 342/20 |

* cited by examiner

*Primary Examiner* — Hung T. Nguyen
(74) *Attorney, Agent, or Firm* — Rabin & Berdo, P.C.

(57) ABSTRACT

A proximate location detection system includes a wireless signal transmitter and a wireless receiver and light emitter. The wireless signal transmitter receives power in response to a first pressure signal and transmits repeatedly a transmission signal generated in response to a second pressure signal during a preset period. The wireless receiver and light emitter receives the transmission signal from the wireless signal transmitter and emits light of various colors using a Light-Emitting Diode (LED) lamp or laser lamp array.

16 Claims, 7 Drawing Sheets

PROXIMATE LOCATION DETECTION SYSTEM

CROSS-REFERENCE TO RELATED APPLICATIONS

The present application claims priority under 35 U.S.C. 119 of Korean Patent Application No. 10-2010-0007285, filed on Jan. 27, 2010, the disclosure of which is expressly incorporated by reference herein in its entirety.

BACKGROUND OF THE INVENTION

1. Field of the Invention

The present invention relates generally to a proximate location detection system, and, more particularly, to a technology in which a wireless receiver and light emitter capable of receiving a wireless signal over a proximate distance is operated in response to a wireless signal from a wireless signal transmitter and intensive light of various colors is emitted by supplying power to a plurality of high-brightness Light-Emitting Diode (LED) lamps or laser lamps during an operation of the wireless receiver and light emitter, so that locations of firefighters can be detected with naked eyes in a smoky and dark space, or a rescuer can easily locate a rescue target by using the emission of light in a proximate distance in the smoky and dark space, thereby enabling rapid rescue.

2. Description of the Related Art

In general, firefighters, when fighting a fire, use flashlights to detect a location of each other or interior structures of a building in an indoor space which is dark due to smoke or cutoff of electric power. However, when the smoke obstructs the vision of the firefighters, it is difficult to view surroundings with naked eyes because most light from the flashlights is absorbed by the smoke.

Although sound can be used instead of light to indicate the firefighters' locations to each other, it frequently fails to detect the locations using only sound due to loud noise from a fire site.

Furthermore, when the firefighter who is fighting the fire inside the building becomes isolated or suffocates and loses consciousness, it is difficult for a rescue corps, which is dispatched from an outside of the building to rescue the isolated firefighter, to detect his or her location.

SUMMARY OF THE INVENTION

Accordingly, the present invention has been made in view of the above problems, and provides detecting locations of a firefighter or a rescue target by emitting light of colors different from those of fire flames using a wireless receiver and light emitter including a plurality of high-brightness lamps having various colors. According to the invention, a transmission signal is repeatedly transmitted by a wireless signal transmitter of a rescuer to be received by the wireless receiver and light emitter attached to, for example, a helmet of the rescue target, e.g., the firefighter located in a proximate distance within, for example, a 10-meter radius range. Accordingly, intensive light of various colors is emitted by high-brightness LED lamps or laser lamps provided in the wireless receiver and light emitter so that the location of the rescue target can be easily detected and rescue measures can be rapidly taken. Furthermore, since the wireless receiver and light emitter operates only upon receiving a wireless transmission signal, current consumption of a battery contained in the wireless receiver and light emitter can be reduced, thereby reducing the size of the system.

In order to accomplish the above object, the present invention provides a proximate location detection system, including a wireless signal transmitter for receiving power in response to a first pressure signal based on a user's manipulation and repeatedly transmitting a transmission signal, generated in response to a second pressure signal based on the user's manipulation, to the outside for a preset period; and a wireless receiver and light emitter for receiving the transmission signal from the wireless signal transmitter and emitting light of various colors using a Light-Emitting Diode (LED) lamp or laser lamp array.

The transmission signal may be repeatedly transmitted every random or preset period of time in a wireless transmission manner so that a rescuer can search for a rescue target firefighter who may be proximate to the rescuer.

The wireless signal transmitter may include a first power switch for receiving the first pressure signal based on the user's manipulation and generating first power request information; a first battery for receiving the first power request information from the first power switch and providing charged power to a signal transmission button; the signal transmission button for receiving the second pressure signal based on the user's manipulation and applying power to a wireless signal transmission module; and the wireless signal transmission module for, when power is supplied from the signal transmission button, repeatedly transmitting the transmission signal every random or preset period of time.

The proximate location detection system may further include a time interval relay for controlling the wireless signal transmission module so that the wireless signal transmission module transmits the transmission signal for a preset duration and repeats the transmission of the transmission signal for the preset duration after lapse of a predetermined period of time.

The range of transmission of the transmission signal transmitted by the wireless signal transmission module may be set to a range from 5 to 10 m so that a location of a rescue target can be easily detected by receiving the transmission signal over a proximate distance as a search range is narrowed.

The wireless receiver and light emitter may include a wireless signal reception module for receiving the transmission signal from the wireless signal transmitter in real time; a second power switch for receiving a third pressure signal based on the user's manipulation and applying power charged in a second battery to a relay; the relay for receiving the power request information from the wireless signal reception module and applying the power charged in the second battery to the LED lamp or laser lamp array; and the LED lamp or laser lamp array configured to include high-brightness LED lamps or laser lamps having a plurality of colors and to be supplied with power by the relay and emit light of various colors.

The various colors of the light may include red, yellow and blue.

The LED lamp or laser lamp array may be attached to a helmet or heatproof clothes.

The helmet may include a first band to which the LED lamp or laser lamp array is attached, which is configured to be detachably attached to the helmet, and which has elastic restoring force.

The heatproof clothes may include a second band to which the LED lamp or laser lamp array is attached, which is configured to be detachably attached to the heatproof clothes, and which has elastic restoring force.

In accordance with one aspect of the present invention, a proximate location detection system comprises: a wireless signal transmitter configured to receive power in response to a first pressure signal and configured to transmit repeatedly a transmission signal generated in response to a second pressure signal during a preset period; and a wireless receiver and light emitter configured to receive the transmission signal from the wireless signal transmitter and configured to emit light of various colors using a Light-Emitting Diode (LED) lamp or laser lamp array.

In one embodiment, the transmission signal may be repeatedly transmitted every random or preset period of time in a wireless manner to locate a rescue target in a proximate location.

In another embodiment, the wireless signal transmitter may comprise: a first power switch configured to receive the first pressure signal and generate first power request information; a first battery configured to receive the first power request information from the first power switch and provide charged power to a signal transmission button; the signal transmission button configured to receive the second pressure signal and apply the power to a wireless signal transmission module; and the wireless signal transmission module configured to, when the power is supplied from the signal transmission button, transmit repeatedly the transmission signal every random or preset period of time.

In a third embodiment, the proximate location detection system may further comprise a time interval relay configured to control the wireless signal transmission module such that the wireless signal transmission module transmits the transmission signal for a preset duration and repeats transmission of the transmission signal for the preset duration after lapse of a predetermined period of time.

In a fourth embodiment, a range of transmission of the transmission signal transmitted by the wireless signal transmission module may be substantially from 5 to 10 m so that a location of a rescue target is easily detected by receiving the transmission signal over a proximate distance as a search range is narrowed.

In a fifth embodiment, the wireless receiver and light emitter may comprise a wireless signal reception module configured to receive the transmission signal from the wireless signal transmitter in real time; a second power switch configured to receive a third pressure signal and configured to apply power charged in a second battery to a relay; the relay configured to receive the power request information from the wireless signal reception module and configured to apply the power charged in the second battery to the LED lamp or laser lamp array; and the LED lamp or laser lamp array configured to include high-brightness LED lamps or laser lamps having a plurality of colors and to receive power from the relay to emit light having the plurality of the colors.

In this fifth embodiment, the plurality of the colors of the light may include red, yellow and blue.

Also, in this fifth embodiment, the LED lamp or laser lamp array may be attached to a helmet or a heat resistive jacket.

Further, in this fifth embodiment, the helmet may comprise a first band in which the LED lamp or laser lamp array is positioned, wherein the first band is detachably attached to the helmet and has elastic restoring force.

Finally, in this fifth embodiment, the heat resistive jacket may comprise a second band in which the LED lamp or laser lamp array is positioned, wherein the second band is detachably attached to the heat resistive jacket and has elastic restoring force.

In accordance with another aspect of the present invention, a proximate location detection system comprises: a wireless signal transmitter configured to receive power in response to a first pressure signal and configured to transmit repeatedly a transmission signal generated in response to a second pressure signal during a preset period, the wireless signal transmitter comprising: a first power switch configured to receive the first pressure signal and configured to generate first power request information; a first battery configured to receive the first power request information from the first power switch and configured to provide charged power to a signal transmission button; the signal transmission button configured to receive the second pressure signal and configured to apply the power to a wireless signal transmission module; and the wireless signal transmission module configured to, when the power is supplied from the signal transmission button, transmit repeatedly the transmission signal every random or preset period of time; a wireless receiver and light emitter configured to receive the transmission signal from the wireless signal transmitter and configured to emit light of various colors using a Light-Emitting Diode (LED) lamp or laser lamp array, the wireless receiver and light emitter comprising: a wireless signal reception module configured to receive the transmission signal from the wireless signal transmitter in real time; a second power switch configured to receive a third pressure signal and configured to apply power charged in a second battery to a relay; the relay configured to receive the power request information from the wireless signal reception module and configured to apply the power charged in the second battery to the LED lamp or laser lamp array; and the LED lamp or laser lamp array configured to include high-brightness LED lamps or laser lamps having a plurality of colors and to receive power from the relay to emit light having the plurality of the colors; and a time interval relay configured to control the wireless signal transmission module such that the wireless signal transmission module transmits the transmission signal for a preset duration and repeats transmission of the transmission signal for the preset duration after lapse of a predetermined period of time.

In one embodiment, the transmission signal is repeatedly transmitted every random or preset period of time in a wireless manner to locate a rescue target in a proximate location.

In a second embodiment, a range of transmission of the transmission signal transmitted by the wireless signal transmission module is substantially from 5 m to 10 m so that a location of a rescue target is easily detected by receiving the transmission signal in a proximate distance as a search range is narrowed.

Also, in this second embodiment, the plurality of the colors of the light include red, yellow and blue.

Further, in this second embodiment, the LED lamp or laser lamp array is attached to a helmet or a heat resistive jacket.

Finally, in this second embodiment, the helmet comprises a first band in which the LED lamp or laser lamp array is positioned, wherein the first band is detachably attached to the helmet and has elastic restoring force.

In this second embodiment, the heat resistive jacket comprises a second band in which the LED lamp or laser lamp array is positioned, wherein the second band is detachably attached to the heat resistive jacket and has elastic restoring force.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENTS

The terms and words used in the present specification and the accompanying claims should not be limitedly interpreted as having common meanings or those found in dictionaries, but should be interpreted as having meanings adapted to the technical spirit of the present invention on the basis of the principle that an inventor can appropriately define the concepts of terms in order to best describe his or her invention. Furthermore, it should be noted that if detailed descriptions of well-known functions or constructions may unnecessarily obscure the gist of the present invention in the specification, the detailed descriptions will be omitted.

Figure 1:
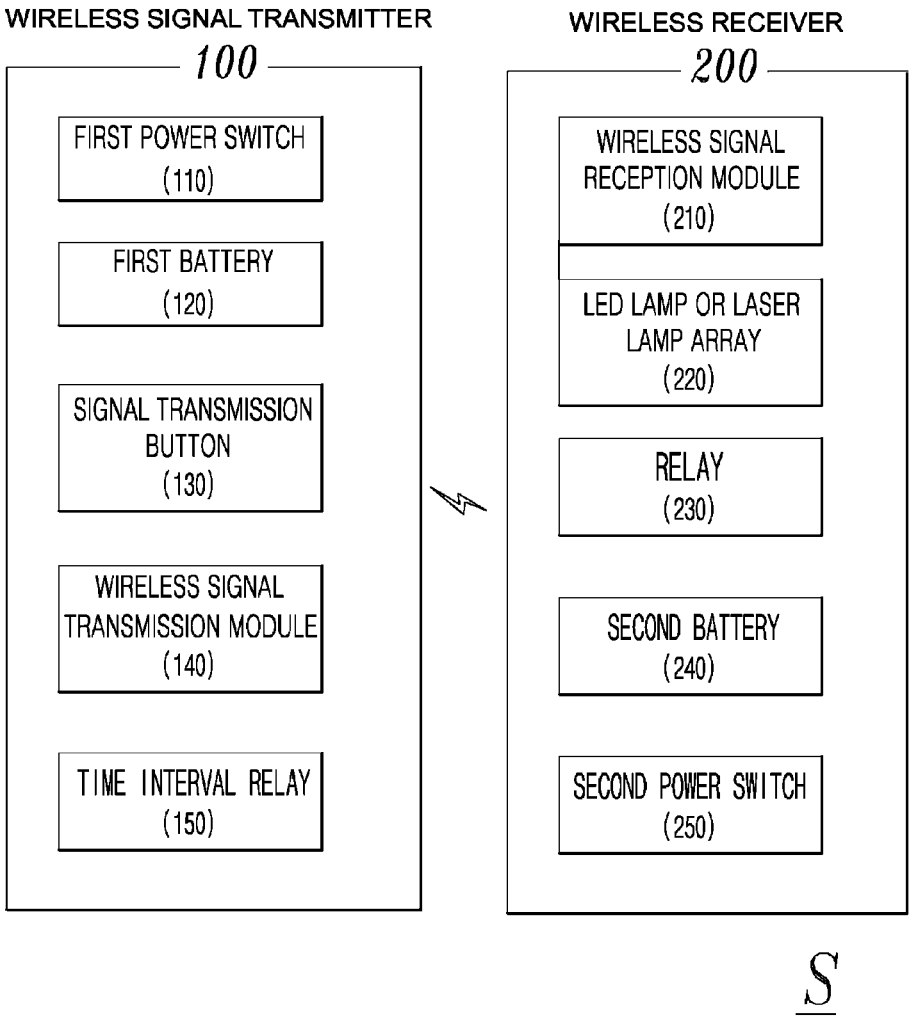
FIG. 1 is a diagram showing a configuration of a proximate location detection system according to an exemplary embodiment of the present invention.
Figure 2:
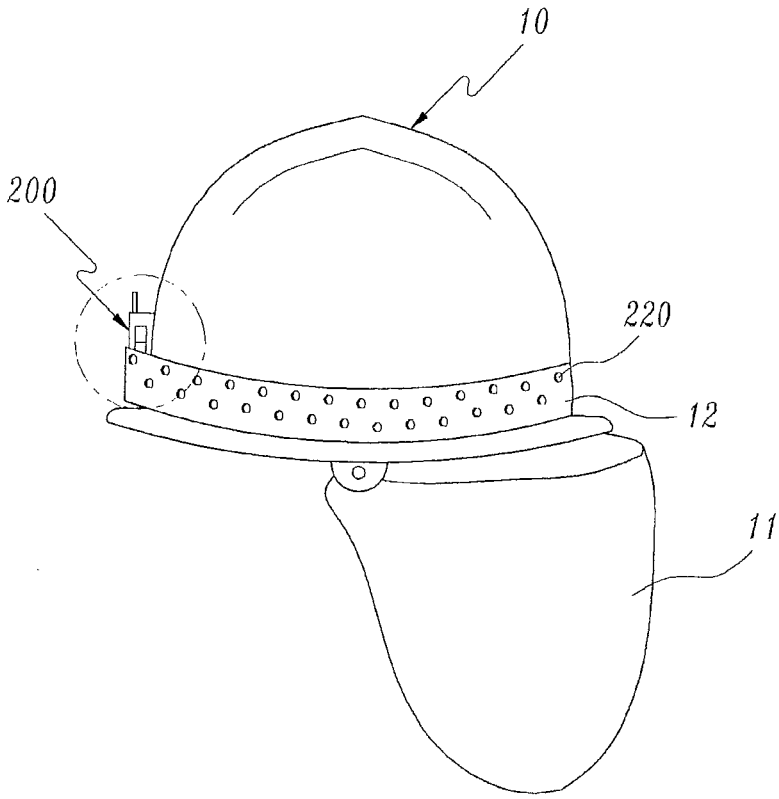
FIG. 2 is a perspective view showing a firefighter's helmet having a wireless receiver and light emitter of the proximate location detection system according to the exemplary embodiment of the present invention.
Figure 3A:
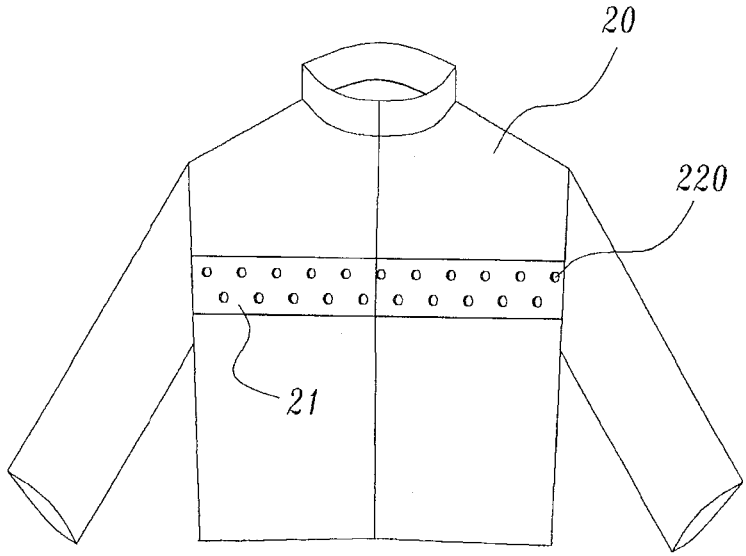
FIG. 3A is a perspective view showing a front of a firefighter's heat resistive jacket having the wireless receiver and light emitter of the proximate location detection system according to the exemplary embodiment of the present invention.
Figure 3B:
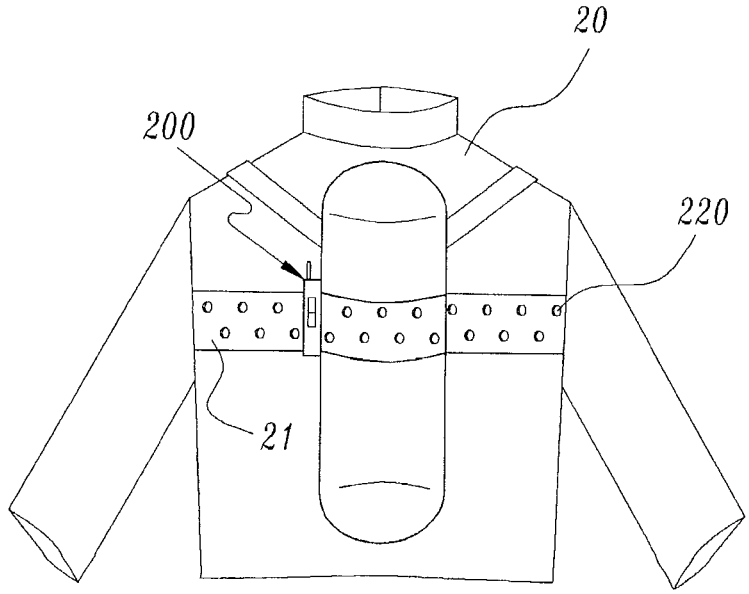
FIG. 3B is a perspective view showing a back of a firefighter's heat resistive jacket having the wireless receiver and light emitter of the proximate location detection system according to the exemplary embodiment of the present invention.
Figure 4:
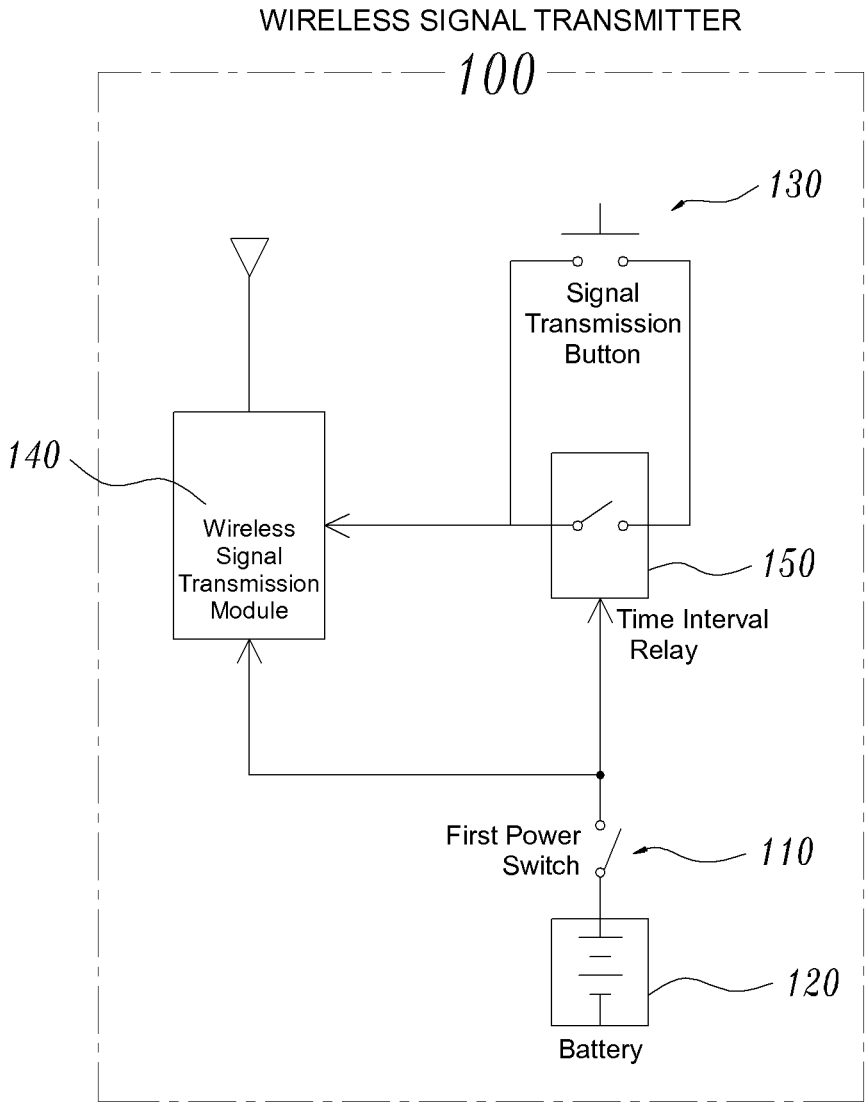
FIG. 4 is a schematic diagram showing the configuration of the wireless signal transmitter of the proximate location detection system according to the exemplary embodiment of the present invention.
Figure 5:
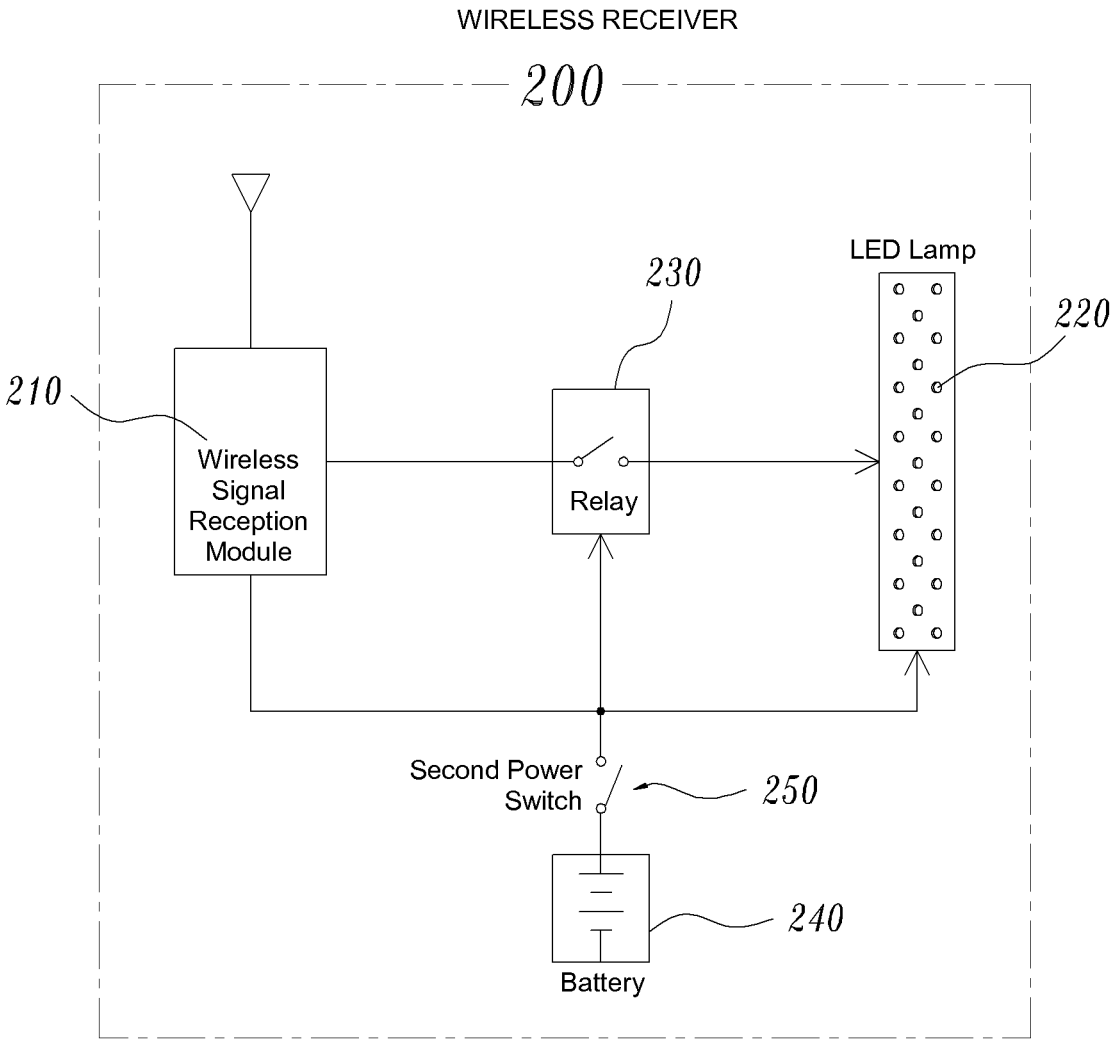
FIG. 5 is a schematic diagram showing the configuration of the wireless receiver and light emitter of the proximate location detection system according to the exemplary embodiment of the present invention.

FIG. 1 is a diagram showing a configuration of a proximate location detection system according to an exemplary embodiment of the present invention. FIG. 2 is a perspective view showing a firefighter's helmet having a wireless receiver and light emitter of the proximate location detection system according to the exemplary embodiment of the present invention. FIGS. 3A and 3B are perspective views showing a front and a back of a firefighter's heat resistive jacket having a wireless receiver and light emitter of the proximate location detection system according to the exemplary embodiment of the present invention. FIG. 5 is a schematic diagram showing the configuration of the wireless receiver and light emitter of the proximate location detection system according to the exemplary embodiment of the present invention. FIG. 4 is a schematic diagram showing the configuration of the wireless signal transmitter of the proximate location detection system according to the exemplary embodiment of the present invention.

As shown in FIGS. 1 to 5, a proximate location detection system S according to the exemplary embodiment of the present invention includes a wireless signal transmitter 100 and a wireless receiver and light emitter 200.

Referring to FIGS. 1 and 4, the wireless signal transmitter 100, supplied with power in response to a first pressure signal based on a user's manipulation, periodically transmits a transmission signal to an outside for a preset period in response to a second pressure signal, and includes a first power switch 110, a first battery 120, a signal transmission button 130, a wireless signal transmission module 140 and a time interval relay 150.

Here, the term "transmission signal" should be understood to include a wireless transmission signal which is repeatedly transmitted using the wireless signal transmission module 140 every random or preset period upon the pressure signal being received by the signal transmission button 130 so that a rescuer can search for a rescue target, e.g., a missing firefighter, who may be at a proximate location.

In particular, the first power switch 110 receives the first pressure signal based on the user's manipulation, and transmits first power request information to the first battery 120, wherein the first power request information is generated based on the first pressure signal.

When the first battery 120 receives the first power request information from the first power switch 110, the first battery 120 provides charged power to the signal transmission button 130.

The signal transmission button 130 receives the second pressure signal based on the user's manipulation to apply power to the wireless signal transmission module 140.

The wireless signal transmission module 140 transmits transmission signals only for a period during which the signal transmission button 130 is being pressed. Although, in this exemplary embodiment, it is assumed that a transmission radius of the wireless signal transmission module 140 is in a range from 5 m to 10 m, the present invention should not be construed as being limited to these examples.

The time interval relay 150 controls transmission such that the transmission can be performed for a preset period and the transmission for the preset period can be repeated after a lapse of a predetermined period so as to enable the wireless signal transmission module 140 to transmit continuously and periodically the transmission signals.

Referring to FIGS. 2, 3 and 5, the wireless receiver and light emitter 200 is attached to a helmet 10 or a heat resistive jacket 20 of the rescue target (e.g., the missing firefighter), and, upon receiving the transmission signal from the wireless signal transmitter 100 carried by the rescuer, emits light of various colors using an LED lamp or laser lamp array 220. The wireless receiver and light emitter 200 includes a wireless signal reception module 210, the LED lamp or laser lamp array 220, a relay 230, a second battery 240 and a second power switch 250.

Here, the colors of the light emitted by the LED lamp or laser lamp array 220 include, for example, red, yellow and blue. The colors of the light emitted from the LED lamp or laser lamp array 220 according to the exemplary embodiment of the present invention are not limited to these examples, but may vary depending on purposes to be served.

In detail, the wireless signal reception module 210 receives the transmission signal from the wireless signal transmitter 100 in real time, and provides power request information generated to the relay 230 based on the received transmission signal.

Furthermore, the LED lamp or laser lamp array 220 includes a plurality of high-brightness LED lamps or laser lamps having various colors, and is provided on part or an entire surface of the helmet 10 or the heat resistive jacket 20. The relay 230 receives the power request information from the wireless signal reception module 210, and allows power of the second battery 240 to be applied to the LED lamp or laser lamp array 220, thereby enabling the plurality of the high-brightness LED lamps or laser lamps having various colors to emit light.

The second power switch 250 is connected between the relay 230 and the second battery 240, and receives a third pressure signal based on the user's manipulation and allows power charged in the second battery 240 to be provided to the relay 230.

Referring to FIG. 2, the helmet 10 may include a face protection see-through cover 11, and a first band 12 having elastic restoring force, onto which the LED or laser lamp array 220 is positioned the first band 12 being detachably attached to the helmet 10.

Furthermore, referring to FIGS. 3A and 3B, a second band 21 onto which an LED lamp or laser lamp array 220 is positioned is detachably attached to a front and a back of the heat resistive jacket 20, and the wireless receiver and light emitter 200 is fastened by the second band 21 having elastic restoring force.

Figure 6:
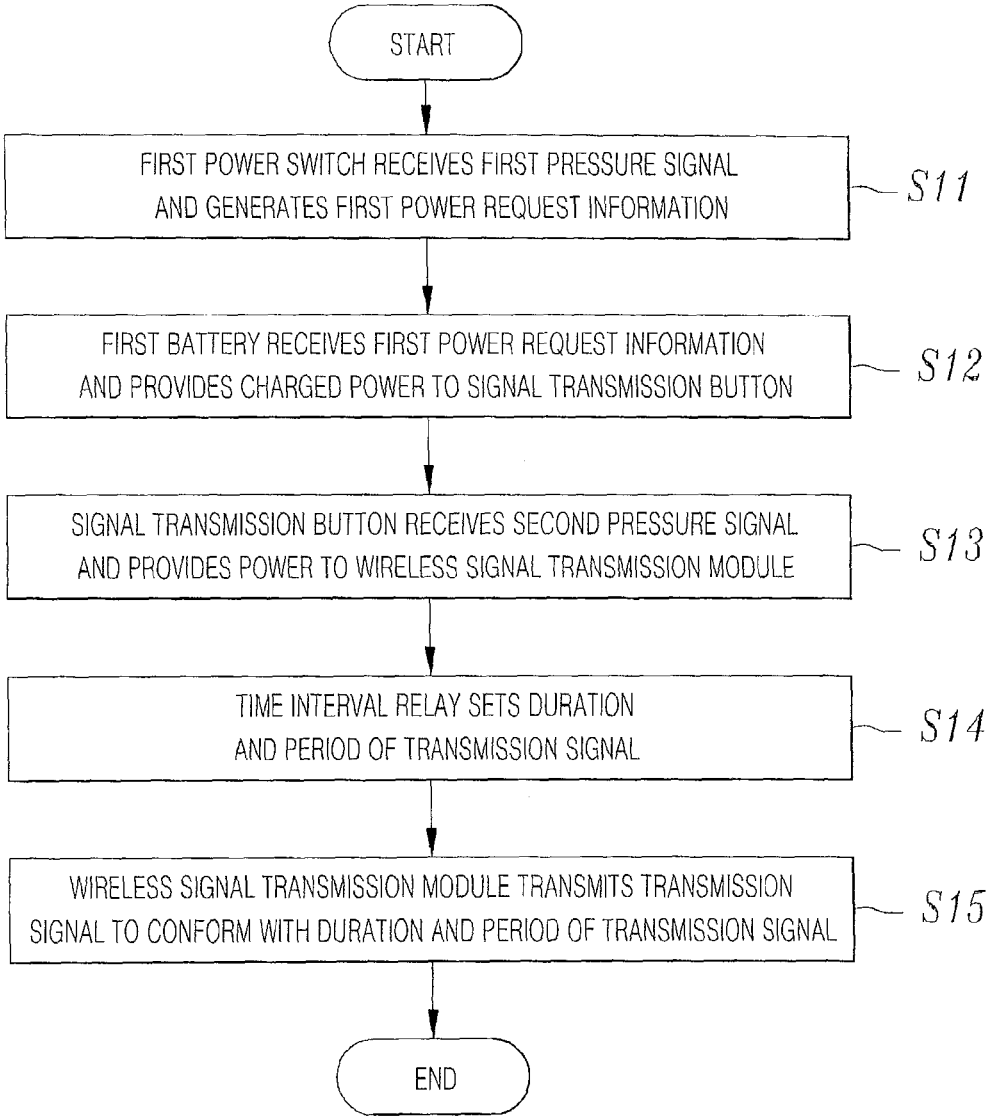
FIG. 6 is a flow chart showing an operation of the wireless signal transmitter according to the exemplary embodiment of the present invention.

FIG. 6 is a flow chart showing an operation of the wireless signal transmitter 100 of the proximate location detection system according to the exemplary embodiment of the present invention.

Figure 7:
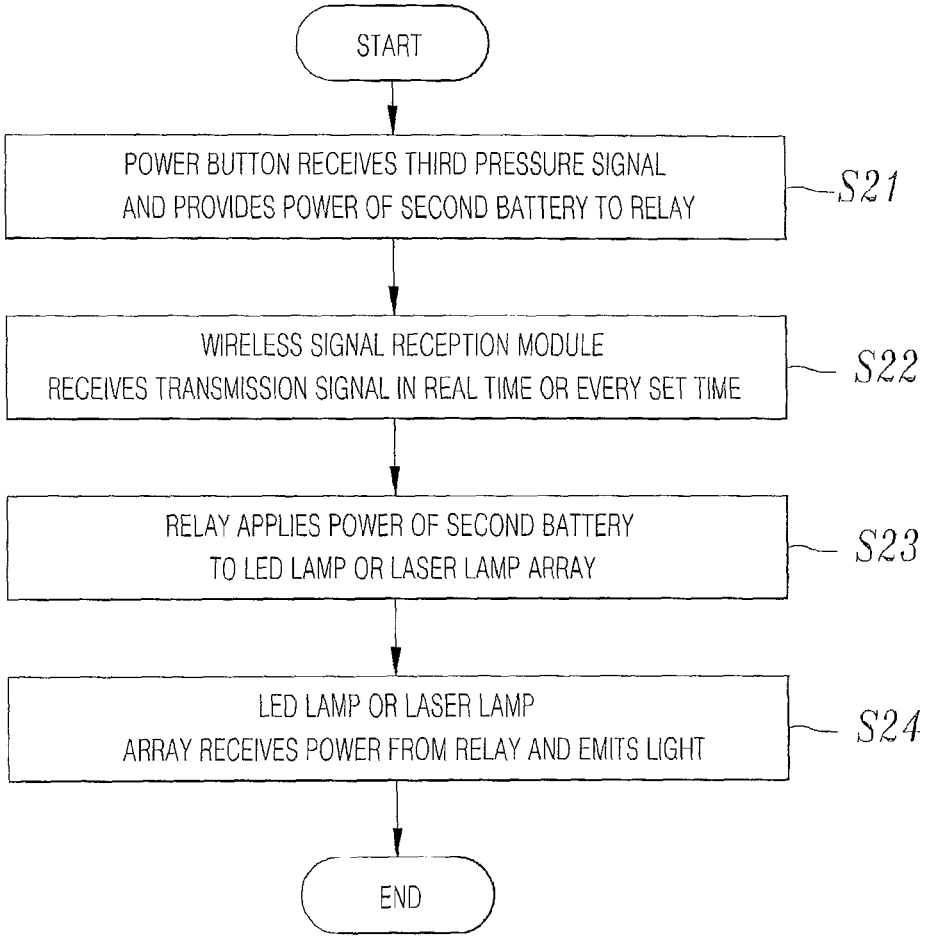
FIG. 7 is a flow chart showing the operation of the wireless receiver and light emitter according to the exemplary embodiment of the present invention.

FIG. 7 is a flow chart showing an operation of the wireless receiver and light emitter 200 of the proximate location detection system according to the exemplary embodiment of the present invention.

As shown in FIG. 6, the first power switch 110 of the wireless signal transmitter 100 according to the exemplary embodiment of the present invention receives the first pressure signal based on the user's manipulation and generates the first power request information at step S11.

Next, the first battery 120 provides charged power to the signal transmission button 130 at step S12.

Next, when the signal transmission button 130 receives the second pressure signal based on the user's manipulation, power is applied to the wireless signal transmission module 140 through the signal transmission button 130 at step S13.

Next, the time interval relay 150 sets a duration and a cycle period of transmission of the transmission signal by the wireless signal transmission module 140 at step S14.

The wireless signal transmission module 140 periodically repeats the transmission and non-transmission of the transmission signal so as to conform with the duration and the cycle period of the transmission set by the time interval relay 150 at step S15.

As shown in FIG. 7, the second power switch 250 of the wireless receiver and light emitter 200 according to the exemplary embodiment of the present invention receives the third pressure signal based on the user's manipulation, and allows power charged in the second battery 240 to be provided to the relay 230 at step S21.

Next, the wireless signal reception module 210 receives the transmission signal from the wireless signal transmitter 100 in real time or at every preset time interval and provides the power request information to the relay 230 at step S22, the power request information being generated by the received transmission signal.

Next, the relay 230 is provided with the power request information by the wireless signal reception module 210 and allows the power of the connected second battery 240 to be applied to the LED lamp or laser lamp array 220 at step S23.

The LED lamp or laser lamp array 220 is supplied with power by the relay 230 and emits light having various colors at step S24.

According to the above-described present invention, by using a color difference between fire flame and the light emitted by the wireless receiver and light emitter including a plurality of high-brightness lamps having various colors, locations of trapped or lost firefighters or the rescue target can be easily detected. When the transmission signal repeatedly transmitted from the wireless signal transmitter of the rescuer within a 10 m-radius range between the rescue target and the rescuer is received by the wireless receiver and light emitter attached to, for example, the helmet of the firefighter, the wireless receiver and light emitter starts to operate. Thus, by operating the wireless receiver and light emitter only upon receiving the wireless transmission signal, current consumption of a battery included in the wireless receiver and light emitter can be lowered, thereby enabling reduction in size of the system.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A proximate location detection system, comprising:

a wireless signal transmitter configured to transmit repeatedly a transmission signal to a rescue target, the wireless signal transmitter including a wireless signal transmission module transmitting the transmission signal to the rescue target, a first power switch receiving a first pressure signal and generating first power request information, a first battery receiving the first power request information from the first power switch and providing a power charged therein to a signal transmission button, and the signal transmission button receiving a second pressure signal and supplying the power to the wireless signal transmission module; and a wireless receiver and light emitter configured to receive the transmission signal from the wireless signal transmitter and configured to emit light using a Light-Emitting Diode (LED) lamp or laser lamp array.

2. The proximate location detection system according to claim 1, wherein the transmission signal is repeatedly transmitted for a random or preset period of time in a wireless manner to locate the rescue target in a proximate location.

3. The proximate location detection system according to claim 1, further comprising:

a time interval relay configured to control the wireless signal transmission module such that the wireless signal transmission module transmits the transmission signal for a preset duration and repeats transmission of the transmission signal for the preset duration after lapse of a predetermined period of time.

4. The proximate location detection system according to claim 1, wherein a range of transmission of the transmission signal transmitted by the wireless signal transmission module is substantially from 5 m to 10 m.

5. The proximate location detection system according to claim 1, wherein the wireless receiver and light emitter comprises:

a wireless signal reception module configured to receive the transmission signal from the wireless signal transmitter in real time;

an LED lamp or laser lamp array configured to emit light;

a second power switch configured to receive a third pressure signal and configured to apply a power charged in a second battery to a relay; and the relay configured to receive the power request information from the wireless signal reception module and configured to apply the power charged in the second battery to the LED lamp or laser lamp array.

6. The proximate location detection system according to claim 5, wherein the LED lamp or laser lamp array includes high-brightness LED lamps or laser lamps having a plurality of colors including red, yellow and blue.

7. The proximate location detection system according to claim 5, wherein the LED lamp or laser lamp array is attached to a helmet or a heat resistive jacket.

8. The proximate location detection system according to claim 7, wherein the helmet comprises a first band in which the LED lamp or laser lamp array is positioned, wherein the first band is detachably attached to the helmet and has elastic restoring force.

9. The proximate location detection system according to claim 7, wherein the heat resistive jacket comprises a second band in which the LED lamp or laser lamp array is positioned, wherein the second band is detachably attached to the heat resistive jacket and has elastic restoring force.

10. A proximate location detection system, comprising:

a wireless signal transmitter configured to receive power in response to a first pressure signal and configured to transmit repeatedly a transmission signal generated in response to a second pressure signal during a preset period, the wireless signal transmitter comprising:

a first power switch configured to receive the first pressure signal and configured to generate first power request information;

a first battery configured to receive the first power request information from the first power switch and configured to provide charged power to a signal transmission button;

the signal transmission button configured to receive the second pressure signal and configured to apply the power to a wireless signal transmission module; and the wireless signal transmission module configured to, when the power is supplied from the signal transmission button, transmit repeatedly the transmission signal every random or preset period of time;

a wireless receiver and light emitter configured to receive the transmission signal from the wireless signal transmitter and configured to emit light of various colors using a Light-Emitting Diode (LED) lamp or laser lamp array, the wireless receiver and light emitter comprising:

a wireless signal reception module configured to receive the transmission signal from the wireless signal transmitter in real time;

a second power switch configured to receive a third pressure signal and configured to apply power charged in a second battery to a relay;

the relay configured to receive the power request information from the wireless signal reception module and configured to apply the power charged in the second battery to the LED lamp or laser lamp array; and the LED lamp or laser lamp array configured to include high-brightness LED lamps or laser lamps having a plurality of colors and to receive power from the relay to emit light having the plurality of the colors; and a time interval relay configured to control the wireless signal transmission module such that the wireless signal transmission module transmits the transmission signal for a preset duration and repeats transmission of the transmission signal for the preset duration after lapse of a predetermined period of time.

11. The proximate location detection system according to claim 10, wherein the transmission signal is repeatedly transmitted every random or preset period of time in a wireless manner to locate a rescue target in a proximate location.

12. The proximate location detection system according to claim 10, wherein a range of transmission of the transmission signal transmitted by the wireless signal transmission module is substantially from 5 m to 10 m so that a location of a rescue target is easily detected by receiving the transmission signal in a proximate distance as a search range is narrowed.

13. The proximate location detection system according to claim 10, wherein the plurality of the colors of the light include red, yellow and blue.

14. The proximate location detection system according to claim 10, wherein the LED lamp or laser lamp array is attached to a helmet or a heat resistive jacket.

15. The proximate location detection system according to claim 14, wherein the helmet comprises a first band in which the LED lamp or laser lamp array is positioned, wherein the first band is detachably attached to the helmet and has elastic restoring force.

16. The proximate location detection system according to claim 14, wherein the heat resistive jacket comprises a second band in which the LED lamp or laser lamp array is positioned, wherein the second band is detachably attached to the heat resistive jacket and has elastic restoring force.

* * * * *